US008739503B2

(12) United States Patent
Smith

(10) Patent No.: US 8,739,503 B2
(45) Date of Patent: Jun. 3, 2014

(54) FOLDABLE CARRIER PACKAGING

(75) Inventor: Daniel T. Smith, Battle Creek, MI (US)

(73) Assignee: Multi Packaging Solutions, Inc., Lansing, MI (US)

( * ) Notice: Subject to any disclaimer, the term of this patent is extended or adjusted under 35 U.S.C. 154(b) by 314 days.

(21) Appl. No.: 13/103,378

(22) Filed: May 9, 2011

(65) Prior Publication Data

US 2011/0272299 A1 Nov. 10, 2011

Related U.S. Application Data

(60) Provisional application No. 61/332,257, filed on May 7, 2010, provisional application No. 61/444,831, filed on Feb. 21, 2011.

(51) Int. Cl.
*B65B 17/02* (2006.01)

(52) U.S. Cl.
USPC ..... 53/443; 53/397; 53/48.1; 53/128.1; 53/134.1

(58) Field of Classification Search
USPC ..... 53/397, 443, 457, 462, 48.1, 134.1, 53/128.1
See application file for complete search history.

(56) References Cited

U.S. PATENT DOCUMENTS

| | | | | |
|---|---|---|---|---|
| 1,795,672 | A * | 3/1931 | Plummer | 206/423 |
| 2,565,449 | A | 8/1951 | Emrick | |
| 3,257,053 | A * | 6/1966 | Mergi | 294/159 |
| 3,432,202 | A * | 3/1969 | Ebelhardt | 294/87.2 |
| 4,155,502 | A * | 5/1979 | Forte | 294/146 |
| 4,184,595 | A | 1/1980 | Wackerman | |
| 4,196,807 | A * | 4/1980 | Brom | 206/427 |
| 5,127,519 | A * | 7/1992 | Tsao | 206/142 |
| 5,609,379 | A * | 3/1997 | Harrelson | 294/87.2 |
| 5,624,024 | A * | 4/1997 | Miess | 206/172 |
| 6,298,992 | B1 * | 10/2001 | Tsao | 206/549 |
| 6,834,762 | B2 | 12/2004 | Krisko et al. | |
| 7,185,758 | B2 * | 3/2007 | Cuomo | 206/162 |
| 8,087,511 | B2 * | 1/2012 | Libit et al. | 206/162 |
| 8,091,702 | B1 * | 1/2012 | Keip | 206/171 |
| 8,522,966 | B1 * | 9/2013 | Siebel | 206/144 |
| 2005/0211578 | A1 * | 9/2005 | Libit | 206/200 |
| 2005/0241964 | A1 * | 11/2005 | Taylor | 206/170 |
| 2008/0006542 | A1 * | 1/2008 | Cuomo | 206/175 |
| 2008/0217207 | A1 | 9/2008 | Hall | |
| 2009/0230083 | A1 * | 9/2009 | Metcalfe et al. | 215/395 |
| 2010/0059578 | A1 * | 3/2010 | Widener | 229/116.1 |

FOREIGN PATENT DOCUMENTS

| | | | |
|---|---|---|---|
| DE | 44 33 489 | A1 | 3/1996 |
| WO | 2009/120829 | A1 | 10/2009 |

OTHER PUBLICATIONS

Copending Design U.S. Appl. No. 29/426,874, filed Jul. 11, 2012.
International Search Report and Written Opinion for corresponding PCT Application No. US2011/035702 filed May 9, 2011, dated Jul. 26, 2011.

* cited by examiner

*Primary Examiner* — Christopher Harmon
(74) *Attorney, Agent, or Firm* — The Dobrusin Law Firm, PC

(57) ABSTRACT

A foldable and flexible carrier which may include a polymeric form that is foldable to provide a carrier having sufficient strength to securely hold and carry items while maintaining position about the items and which can be assembled without fastening hardware.

10 Claims, 3 Drawing Sheets

FOLDABLE CARRIER PACKAGING

CLAIM OF PRIORITY

This application claims the benefit of the filing date of U.S. Provisional Application Ser. No. 61/444,831 (filed Feb. 21, 2011) and No. 61/332,257 (filed May 7, 2010), the contents of these applications being hereby incorporated by reference for all purposes.

FIELD OF THE INVENTION

The present teachings relate generally to foldable carriers, and more specifically to flexible temporary carrier and packaging systems having sufficient strength to supportably hold and carry one or more items about an intermediate portion of the item by gripping from overhead while maintaining position about the items and which can be assembled without separate fastening hardware.

BACKGROUND OF THE INVENTION

Packaging solutions commonly provide for simple enclosure of goods. However, many packaging systems fail to provide for special needs that a particular good may require. Specifically, plant-related items such as potted plants and bouquets may require specialized packaging beyond that of a standard box structure. As an example, the weight and shape of potted plants make carrying and transport of such goods challenging with box-type packaging. Further, the variability in size and shape of plant-related goods presents additional problems for creating a standardized packaging. Plant products may also require packaging that allows the products to be viewed and inspected by perspective customers. Retailers may also prefer a packaging that is simple and easily applied to an item so that the packaging can be applied efficiently during the checkout process.

U.S. Pat. No. 6,834,762 teaches a foldable beverage carrier. The patent does not teach a carrier that is free of a supporting bottom, nor does the patent teach an article retention structure located in a side wall of the carrier.

U.S. Publication No. 2005/0211578 discloses a cup carrier. The application fails to disclose article retention structures in the side walls.

U.S. Publication No. 2008/0217207 discloses a beverage or food carrier. The application fails to disclose article retention structures.

Accordingly, in view of the above, there exists a need for a product carrier and packaging system which overcomes some or all of the above drawbacks in the art. For example, there is a need for a carrier and packaging system that provides both carrying and packaging function with a foldable one-piece substrate while maintaining the packaging securely about the items located within the packaging. There is a further need for a carrier and packaging system that is flexible, foldable and temporary while securely maintaining plant and floral related goods of varying size within the packaging so that the goods may be viewed from outside the packaging. There is also a need for a one-piece carrier and packaging that allows for simplified one-handed carrying of goods having a shape that generally requires two hands for carrying.

SUMMARY OF THE INVENTION

The present teachings meet some or all of the above needs by providing a carrier and packaging system that includes a one-piece foldable substrate including a base portion, a plurality of side walls, one or more apertures for creating a handle and one or more article retention structures to assist in maintaining the packaging about the items located within the packaging. Advantageously, the carrier may be formed (e.g., die-cut, scored and/or pre-broken) from a single sheet form (e.g., a polymeric form). The base portion may include one or more openings for receiving an item. The plurality of side walls may each have a first end connected to the base portion, a second end including one or more apertures for forming a handle portion, and at least two laterally spaced apart side edges. The base portion, side walls, or both may include one or more score lines for folding the carrier about one or more items located within the carrier. Upon folding, the second ends of each side wall may contact one another so that the apertures located in each side wall align to form a handle portion for carrying. Also contemplated within the scope of the teachings herein are generally planar sheet forms that are shaped and scored so that the form folds upon itself to form a carrier as described herein.

The teachings herein further provide for a method for packaging an item comprising providing a one piece flexible carrier, locating one or more items within the carrier, locating one or more article retention structures within each item, and folding the carrier along one or more score lines so that the packaging is formed. The carrier may include a base portion having one or more openings for receiving an item and a plurality of side walls each having a first end that is connected to the base portion, a second end opposing the first end, at least two laterally spaced apart side edges. The carrier may further include one or more apertures located proximate the second end of each side wall, one or more score lines located at a connection point of the base portion and first end, and at least one article retention structure located adjacent the one or more openings for receiving an item, the article retention structure including a tab portion having at least one free end. The items located within the packaging may each have a top edge and a bottom edge so that the bottom edge of each item is placed through the opening for receiving the items and the bottom edge is suspended without any support contacting the bottom edge. The tab portions of the at least one article retention structure may be located within each item so that the tab engages the top edge of each item.

The teachings herein further provide for a method of packaging and carrying a plurality of potted plants comprising providing a one piece flexible carrier, locating one or more potted plants within the carrier, locating one or more article retention structures within each potted plant, and folding the carrier along one or more score lines so that the packaging is formed. The carrier may include a base portion having one or more openings for receiving a potted plant and a plurality of side walls each having a first end that is connected to the base portion, a second end opposing the first end, at least two laterally spaced apart side edges. The carrier may further include one or more apertures located proximate the second end of each side wall, one or more score lines located at a connection point of the base portion and first end, and at least one article retention structure located adjacent the one or more openings for receiving a potted plant, the article retention structure including a tab portion having at least one free end. The potted plants located within the packaging may each have a top edge and a bottom edge so that the bottom edge of each potted plant is placed through the opening for receiving the potted plants and the bottom edge is suspended without any support contacting the bottom edge. The tab portions of the at least one article retention structure may be located within each potted plant so that the tab engages the top edge of each potted plant.

The carrier herein offers any of a number of benefits and advantages, including but not limited to one or any combination of the following attributes. A portion of the carrier and packaging system may remain open for both expanded contents space and display purposes. The carrier and packaging system may include retaining means that may include both the openings for receiving items and the article retention structures, either or both having adjustability for shape and size of the carrier contents. The article retention structures may assist in maintaining the packaging about items located within by holding the packaging in place when not being carried. The one-piece planar nature of the carrier and packaging system may allow for simplified printing of informational and decorative material onto the carrier. The one-piece planar nature may also allow the carrier and packaging system to be stacked in flattened form so that they are more easily shipped to a retailer and require a small amount of shipping space. The carrier and packaging system may be substantially free of vertical side-wall portions. The carrier and packaging system may be formed so that items located therein are suspended and not supported from the bottom of the items.

DETAILED DESCRIPTION

Figure 1:
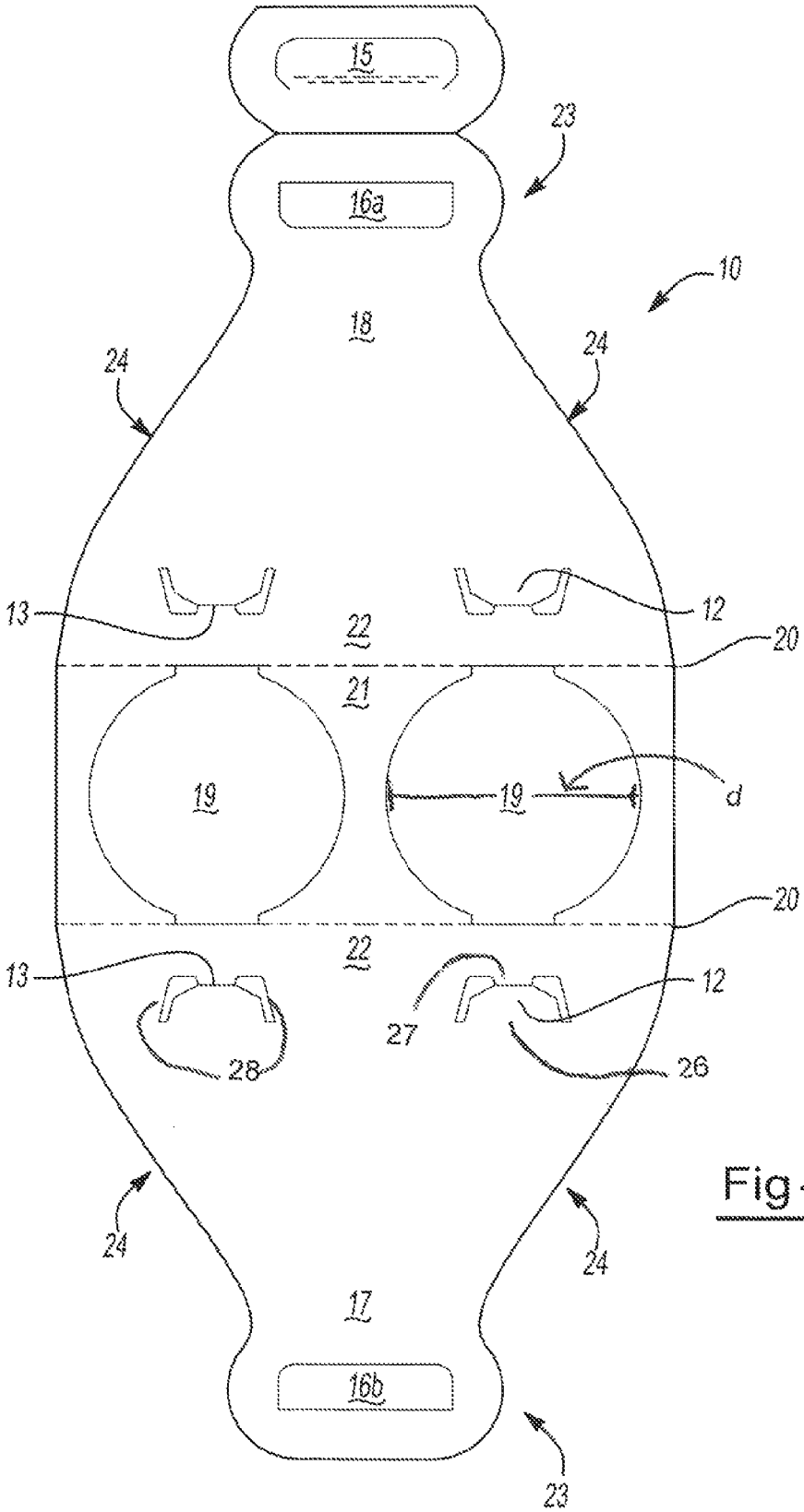
FIG. 1 is a top-down view of an illustrative example of the carrier of the present teachings, prior to folding.

In general, the teachings herein provide for a carrier and packaging system that includes a one-piece foldable substrate including a base portion, a plurality of side walls, one or more apertures for creating a handle and one or more article retention structures for maintaining the packaging about any items located within the packaging. The base portion may include one or more openings for receiving one or more items. The plurality of side walls may each have a first end and a second end and two laterally spaced apart side edges. The first end may be connected to the base portion and may be adjacent one or more score lines along which the carrier may be folded. The second end may include one or more apertures for forming a handle portion. Each of the plurality of side walls may also include one or more article retention structures which may be formed by forming openings (e.g., slots) into the side walls. The formed openings may create a tab portion having at least one free end. The carrier may be folded along the score lines so that the plurality of side walls are folded toward one another and the apertures located within the side walls align with one another to form a handle structure. An additional wrap tab may be located adjacent at least one of the apertures so that the wrap tab is placed through each aperture to maintain the apertures in alignment with one another, and to assist in maintaining the carrier in position about the items located within. The apertures may have identical geometries (e.g., shapes and sizes) so that they align with one another to form one common aperture.

The carrier may include one opening for receiving an item. The carrier may include two, three, or four openings for receiving an item. The shape of the openings may each be identical, or the shape of each opening may differ. The size and shape of each opening may be formed so that items having a tapered shape may be located into each opening and the opening will contact the item at an intermediate portion where the dimension of the item has substantially the same dimension as the opening. Thus, the opening may be formed to receive an item that has a dimension at some point along its length that corresponds to the dimension of the opening. The openings may be substantially circular and may have a diameter (d) of at least about 50 mm. The diameter of the openings may be at least about 100 mm or even at least about 150 mm. The openings may be substantially rectangular and may have a length (I) of at least about 30 mm and a width (w) of at least about 30 mm. The openings may have a length of at least about 50 mm, at least about 100 mm or even at least about 150 mm. The openings may have a width of at least about 50 mm, at least about 100 mm or at least about 150 mm.

Each opening for receiving an item may include two article retention structures, each located on opposing side walls of the carrier. The carrier may be free of any structure that supports the bottom of any items located within the carrier so that the bottom of any item located within the carrier is not in contact with any portion of the carrier once placed therein. Upon locating an item within an opening for receiving an item, the opening may contact the item at an intermediate location. The dimensions of the opening may be substantially similar to the dimensions of the item at the intermediate location so that the item resists pulling through the opening. The article retention structures may be located within the item so that when the packaging is not being carried, the packaging will remain in contact with the items along the intermediate portion. The engagement of the article retention structures will allow the packaging to substantially resist any downward force that would cause the opening to fall below the intermediate portion of the items. As a result, the openings contact the same intermediate portion of the items when the packaging is carried as when the packaging is not being carried (e.g., when the packaging and its contents are resting on a horizontal surface). Upon engagement of the article retention structures with an item located in the packaging, the tab portion of the article retention structure may contact the contents of an item. For example the tab may contact soil in the event that the item is a potted plant. The contents of the item may thus provide additional upward force and support for maintaining the packaging about the items when the packaging is not being carried.

As shown for example in FIG. 1, the carrier 10 may include a base portion 21, including one or more openings 19 for receiving an item. The base portion 21 may include one or more score lines 20 for folding the carrier. The carrier may further include one or more side walls 17, 18 having one or more article retention structures 13 including a tab portion 12. The article retention structures may further include a top edge 26 from which the tab portion 12 extends, a bottom edge 27, and two side edges 28. The side walls 17, 18 of the packaging may include a first end 22 connected to the base portion and a second end 23, along with one or more side edges 24. The side walls 17, 18 may also include one or more apertures **16*a*, 16*b* for forming a handle portion. One or more side walls 18 may also include wrap tab 15 placed through the one or more apertures 16*a*, 16*b*** for forming the handle portion.

Figure 2:
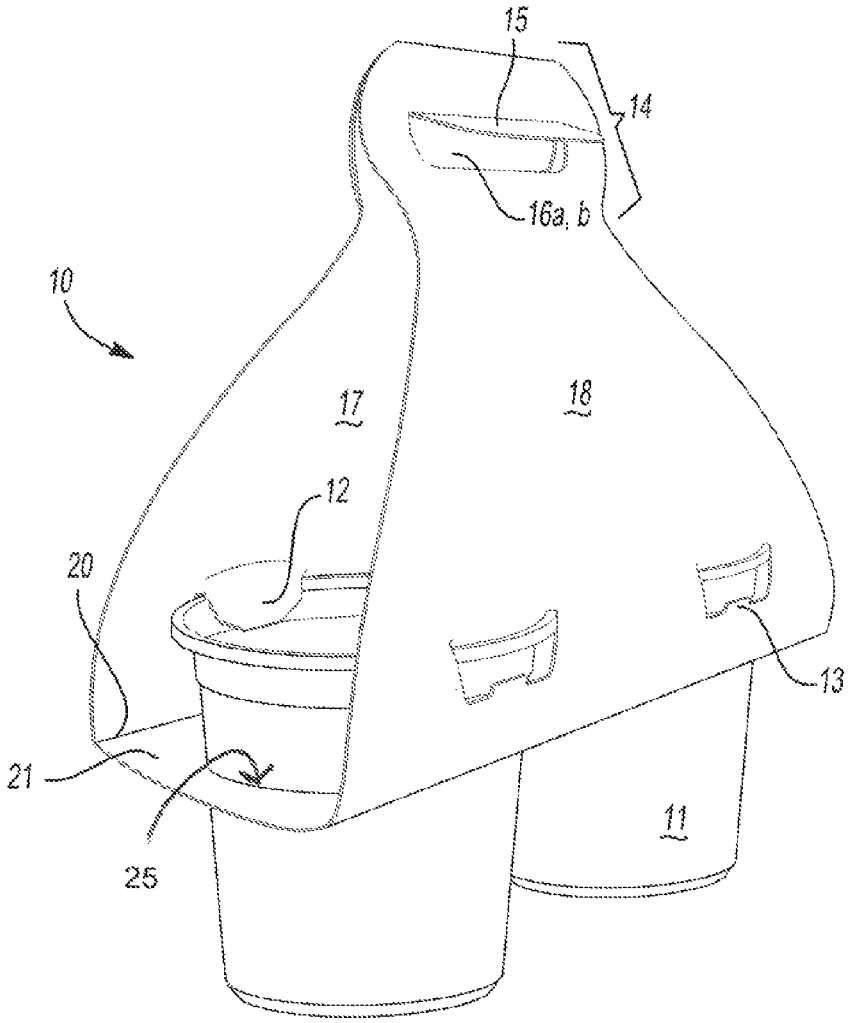
FIG. 2 is a perspective view of the carrier shown at FIG. 1 while in use.

FIG. 2 shows an example of the carrier folded and in use. The carrier 10 may include a base portion 21 having one or more openings 19 for receiving one or more items 11. The one or more items 11 may further contact one or more article retention structures 13 having a tab portion 12. The tab portion 12 may be located within the item 11 as shown. The tab portion 12 may contact a portion of the contents of the item (not shown). The openings 19 for receiving the items 11 may contact the items at an intermediate portion 25 of the items.

The side walls 17, 18 may be folded along one or more score lines 20 toward one another so that the apertures 16*a*, 16*b* adjacent each side wall may align with one another to form a handle portion 14. A wrap tab 15 may be located adjacent one or more apertures 16*a* so that the apertures 16*a*, 16*b* may align and the wrap tab 15 may be placed through the aligned apertures.

Figure 3:
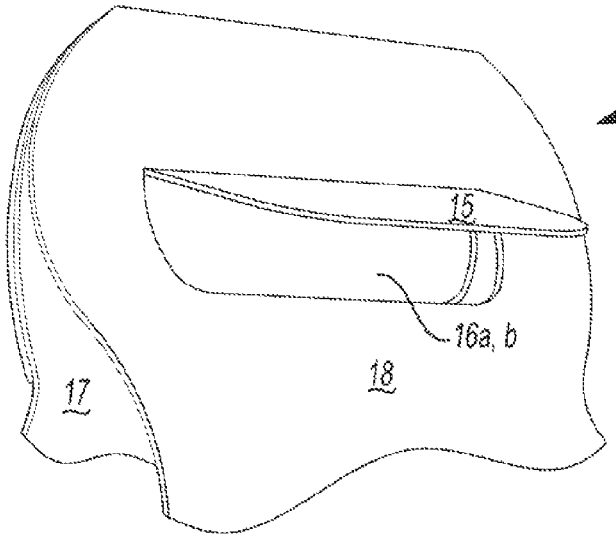
FIG. 3 is a perspective view of the handle portion of the carrier as shown in use in FIG. 2.

FIG. 3 depicts an example of the handle portion 14. One side wall 17, may include an aperture 16*b*. Another side wall 18, may include an aperture 16*a* and a wrap tab 15. The wrap tab 15 may be located adjacent the portion of the side. wall 18 surrounding the aperture 16*a*. When the carrier is folded and one or more items are placed within the carrier, the apertures 16*a*, 16*b* may be aligned with one another so that the wrap tab 15 can be placed through both apertures so that a handle portion 14 is formed and so that the carrier remains folded and remains in place about the items.

Figure 4:
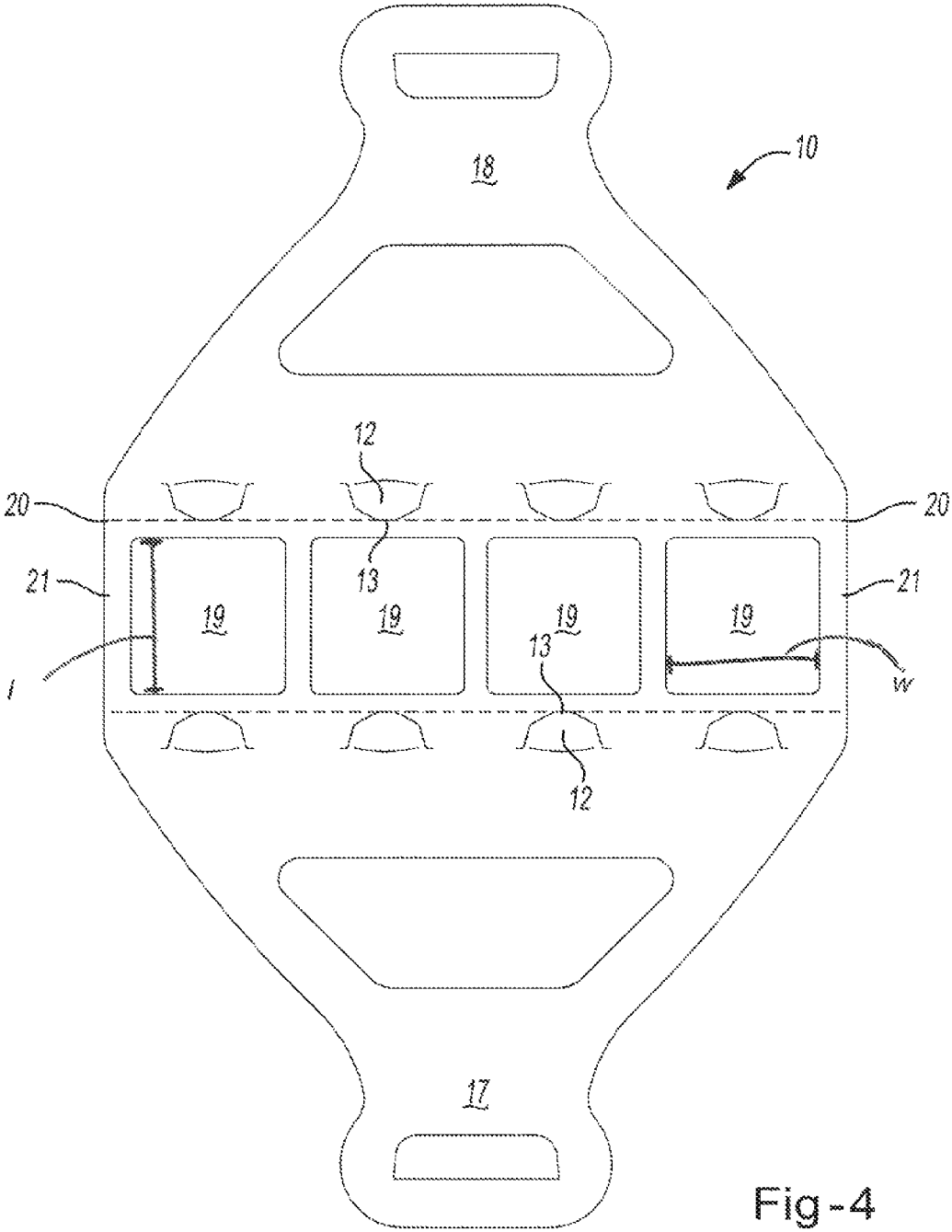
FIG. 4 is a top-down view of an illustrative example of the present teachings, prior to folding.

As shown for example in FIG. 4, the carrier 10 may include a base portion 21, including one or more openings 19 for receiving an item. FIG. 4 depicts an example packaging showing four openings 19 for receiving an item. The base portion 21 may include one or more score lines 20 for folding the carrier. The carrier may further include one or more side walls 17, 18 having one or more article retention structures 13 including a tab portion 12 that correspond with the number of openings 19 for receiving an item.

The carrier and packaging system may be made from a sheet form (e.g., a polymeric form) that initially is provided in a flat format that will typically include preselected scoring for precise fold lines so that the carrier may be easily and precisely machine-folded or hand-folded to define a finished carrier that is flexible yet capable of carrying multiple potted plants while remaining intact.

The carrier may be formed in a standard shape, but produced in a number of varying sizes. The carrier may further include one or a plurality of article retention structures so that it may contain any of a wide range of product. sizes within it. For example, it can contain pots for horticultural purposes, bouquets, or other arrangements across a range of sizes. It is also possible that the resulting carrier and packaging system is capable of securely fitting and locking in place a specific size range of products without the need for additional packing materials or coverings.

Prior to folding, the carrier may be a flat sheet material (e.g., a polymeric form) that is die cut and scored to obtain the necessary shape and to impart scored fold lines. In its folded format, the carrier may include an exterior surface, an interior surface, a base portion and a plurality of side walls. As an additional benefit of the foldable nature of the carrier disclosed herein, the carrier may be free of additional hardware for maintaining the carrier in a folded format. The carrier may be free of fasteners, closures, hooks, handles, clips, eyelets, or any other hardware.

Upon folding along the score lines, the carrier may include one or more article retention structures that secure the packaging about any items located within the packaging. This article retention structure thus allows items to be maintained within the carrier without the need for a support structure along the bottom of the items. The article retention structure may be included in a variety of locations so that items over a wide range of sizes may be securely placed into a standard carrier. As an example, the carrier may be manufactured in a finite number of incrementally increasing standard sizes (e.g., three, four, five, or more standard sizes) that are adapted to receive a larger number of different articles (e.g., more than four different sized pots, in the case of horticulture products). Each of these standard sizes may contain a number of article retention structures so that each standard carrier is capable of securely locking items having a range of sizes.

The base substrate for forming the carrier may be any material pliable enough to be scored and folded but strong enough to withstand the weight of a contained item. A particular feature of the material may be that it is durable enough to hold and carry potted plants without tearing the substrate. The substrate may be formed of paper materials including but not limited to paperboard, chipboard, cardboard, fiberboard, natural fibers, mineral fibers or any combination thereof. The material may be a virgin material, a post-consumer recycled material, or both. The substrate material may be a recyclable material and/or a biodegradable material. If the substrate material includes paperboard, the paperboard may be a bleached or unbleached paperboard. For example it may be a solid bleached sulfate (SBS) paperboard. The material may contain a major portion that can be recycled. The base substrate material may be formed of a polymeric material including but not limited to thermoplastics, thermoset plastics, elastomeric containing materials or any combination thereof. Examples of polymeric materials that may be employed include polyamide, polyester, polystyrene, polyethylene (including polyethylene terephthlate, high density polyethylene and low density polyethylene), polypropylene, polyvinyl chloride, bio-based plastics/biopolymers (e.g., poly lactic acid), silicone, acrylonitrile butadiene styrene (ABS), or any combination thereof.

The base substrate material may be a water-resistant material. The gauge of the base substrate material may vary depending on the size of the carrier or the desired strength of the packaging.

The carrier may also include designs or coverings to add a decorative element to the carrier and packaging system. The carrier may be covered with a decorative coating that is extruded onto the exterior of the carrier, the interior of the carrier, or both. As an example, the carrier material may be covered in a metallic coating (e.g., a metalized polyethylene and/or polyester coating). The carrier may include a foil covering. The carrier may also include a coating for projecting a holographic-type image or pattern. Any coating or other design element may be attached to any surface of the carrier via an adhesive. Any coating or other design element may be ink jet or laser printed directly onto any surface of the carrier. Any surface of the carrier may be embossed, printed, silk-screened, or engraved with a design element. Any design element or coating may be customizable. A customized design element may be added to the carrier at a point of manufacture or may be added to the carrier at a point of sale. Any coating or design element may include a pre-loaded adhesive material or other attachment means for simplified placement of the coating or design element onto the carrier.

Any numerical values recited herein include all values from the lower value to the upper value in increments of one unit provided that there is a separation of at least 2 units between any lower value and any higher value. As an example, if it is stated that the amount of a component or a value of a process variable such as, for example, temperature, pressure, time and the like is, for example, from 1 to 90, preferably from 20 to 80, more preferably from 30 to 70, it is intended that values such as 15 to 85, 22 to 68, 43 to 51, 30 to 32 etc. are expressly enumerated in this specification. For values which are less than one, one unit is considered to be 0.0001, 0.001, 0.01 or 0.1 as appropriate. These are only examples of what is specifically intended and all possible combinations of numerical values between the lowest value and the highest value enumerated are to be considered to be expressly stated in this application in a similar manner. As can be seen, the teaching of amounts expressed as "parts by weight" herein also contemplates the same ranges expressed in terms of percent by weight. Thus, an expression in the Detailed Description of the Invention of a range in terms of at "'x' parts by weight of the resulting polymeric blend composition" also contemplates a teaching of ranges of same recited amount of "x" in percent by weight of the resulting polymeric blend composition."

Unless otherwise stated, all ranges include both endpoints and all numbers between the endpoints. The use of "about" or "approximately" in connection with a range applies to both ends of the range. Thus, "about 20 to 30" is intended to cover "about 20 to about 30", inclusive of at least the specified endpoints.

The disclosures of all articles and references, including patent applications and publications, are incorporated by reference for all purposes. The term "consisting essentially of" to describe a combination shall include the elements, ingredients, components or steps identified, and such other elements ingredients, components or steps that do not materially affect the basic and novel characteristics of the combination. The use of the terms "comprising" or "including" to describe combinations of elements, ingredients, components or steps herein also contemplates embodiments that consist essentially of the elements, ingredients, components or steps. By use of the term "may" herein, it is intended that any described attributes that "may" be included are optional.

Plural elements, ingredients, components or steps can be provided by a single integrated element, ingredient, component or step. Alternatively, a single integrated element, ingredient, component or step might be divided into separate plural elements, ingredients, components or steps. The disclosure of "a" or "one" to describe an element, ingredient, component or step is not intended to foreclose additional elements, ingredients, components or steps.

It is understood that the above description is intended to be illustrative and not restrictive. Many embodiments as well as many applications besides the examples provided will be apparent to those of skill in the art upon reading the above description. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. The omission in the following claims of any aspect of subject matter that is disclosed herein is not a disclaimer of such subject matter, nor should it be regarded that the inventors did not consider such subject matter to be part of the disclosed inventive subject matter.

What is claimed is:

1. A method for packaging an item comprising:

providing a one piece flexible carrier including:

i. a base portion having one or more openings for receiving an item;

ii. a plurality of side was each having a first end that is connected to the base portion, a second end opposing the first end, at least two laterally spaced apart side edges;

iii. one or more apertures located proximate the second end of each side wall;

iv. one or more score lines located at a connection point of the base portion and first end;

v. at least one article retention structure located adjacent the one or more openings for receiving an item, the article retention structure including a tab portion having at least one free end;

locating one or more items, each having a top edge and a bottom edge into the one or more openings for receiving an item so that the bottom edge of each item is placed through the opening and the bottom edge is suspended without any support contacting the bottom edge;

locating one or more tab portions of the article retention structures within each item so that the tab engages the top edge of each item;

folding the carrier along each score line so that the second end of each side wall contacts the second end of an opposing side wall.

2. The method of claim 1, wherein upon folding the carrier along each score line, the second end of each side wall contacts the second end of an opposing side wall so that the apertures located proximate the second end of each side wall correspondingly align with one another creating one common aperture to form a handle portion.

3. The method of claim 2, wherein one side wall includes a wrap tab that is placed through the common aperture located proximate the second end of each side wall to maintain the apertures in alignment with one another so that the carrier remains folded and the handle portion remains intact.

4. The method claim 1, wherein the article retention structure includes a bottom edge, two side edges and a top edge from which the tab extends.

5. The method claim 1, wherein the top edge of the item contacts the top edge of the article retention structure.

6. The method of claim 4, wherein the article retention structures substantially prevent the packaging from becoming disengaged from the items by maintaining the tab within the item so that the top edge of the article retention structure does not fall below the top edge of the item.

7. The method claim 1, wherein the article retention structures substantially maintain the openings for receiving the items in a consistent location about the items.

8. The method claim 1, wherein the openings for receiving the items are located at an intermediate portion of the items when the packaging is carried and the openings for receiving the items are located at substantially the same intermediate portion when the packaging is not carried.

9. A method for packaging and carrying a plurality of potted plants comprising:

providing a one piece flexible carrier including:

i. a base portion having a plurality of openings for receiving a potted plant;

ii. a plurality of side walls each having a first end that is connected to the base portion, a second end opposing the first end, at least two laterally spaced apart side edges;

iii. one or more apertures located proximate the second end of each side wall;

iv. one more score lines located at a connection point of the base portion and first end;

v. a plurality of article retention structures located adjacent the plurality of openings for receiving a potted plant, the article retention structures including a tab portion having at least one free end;

locating a plurality of potted plants, each having top edge and bottom edge into the plurality of openings for receiving a potted plant so that the bottom edge of each potted plant is placed through the opening and the bottom edge is suspended without any support contacting the bottom edge;

locating one or more tab portions of the article retention structures within each potted plant so that the tab engages the top edge of each potted plant;

folding the carrier along each score line so that the second end of each side wall contacts the second end of an opposing side wall.

10. The method of claim 9, wherein the free end of the tab contacts at least a portion of the contents of each of the plurality of potted plants.

* * * * *